United States Patent [19]

Hale

[11] Patent Number: 4,567,841

[45] Date of Patent: Feb. 4, 1986

[54] FAIRING ASSEMBLY FOR TOWED UNDERWATER CABLES

[75] Inventor: Neville E. Hale, Mississauga, Canada

[73] Assignee: Fathom Oceanology Limited, Mississauga, Canada

[21] Appl. No.: 472,240

[22] Filed: Mar. 4, 1983

[30] Foreign Application Priority Data

Jan. 18, 1983 [CA] Canada ..... 419704

[51] Int. Cl.[4] ..... F15D 1/10

[52] U.S. Cl. ..... 114/221 R; 114/243; 228/212; 228/230

[58] Field of Search ..... 114/221 R, 243; 228/44.1 R, 51, 126–128, 156, 212, 228, 230, 243

[56] References Cited

U.S. PATENT DOCUMENTS

| | | | |
|---|---|---|---|
| 2,241,513 | 3/1966 | Rather et al. | 114/243 |
| 2,987,029 | 6/1961 | Manuel | 114/243 |
| 3,092,067 | 6/1963 | Armstrong | 114/243 |
| 3,224,406 | 12/1965 | Clark | 114/243 |
| 3,233,571 | 2/1966 | Rather et al. | 114/243 |
| 3,352,274 | 11/1967 | Calkins | 114/243 |
| 3,407,777 | 10/1968 | Anastasio et al. | 114/243 |
| 3,571,908 | 3/1971 | Pilia | 228/212 |
| 3,611,976 | 10/1971 | Hale et al. | 114/243 |
| 3,634,649 | 1/1972 | Rager | 228/212 |
| 3,693,243 | 9/1972 | Steigelman | 228/230 |
| 3,777,361 | 12/1973 | Fuchs | 228/128 |
| 4,032,382 | 6/1977 | Obeda | 228/243 |
| 4,075,967 | 2/1978 | Silvey | 114/243 |

*Primary Examiner*—Trygve M. Blix
*Assistant Examiner*—Stephen P. Avila
*Attorney, Agent, or Firm*—Donald E. Hewson

[57] ABSTRACT

A fairing and a fairing assembly for towed underwater cables is provided, having two different embodiments of fairings. In the first embodiment, each fairing has a flexible nose portion and a substantially rigid tail portion having separable halves, with the connection between the nose portion and the tail portion being by way of a flange at each side at the rear of the nose portion fitting into a channel at the front of each of the half pieces of the tail portion, and with the channel being interrupted by a shear block which is accommodated by a discontinuity in the nose portion flanges. A special arrangement is made having half-length nose portions, and using a flexible link between at least certain ones of adjacent fairings, where the half-length nose portion accommodates a ring secured to the periphery of the cable. The fairings may be grouped either for compression loading against a ring at the bottom of each group, or for tension loading from a ring at the top of each group, whereby a better tow-off characteristic is gained. The second embodiment of fairings comprises an extruded one piece fairing having a high modulus of elasticity with a single nose portion for a plurality of tail portions. The compression ring and a tool for fitting it to the cable are also taught.

2 Claims, 14 Drawing Figures

FAIRING ASSEMBLY FOR TOWED UNDERWATER CABLES

FIELD OF THE INVENTION

This invention relates to fairings and fairing assemblies for towed cables, particularly underwater towed cables, whereby the resistance to motion of the faired cable may be considerably lessened with respect to the resistance to motion of an unfaired cable, when towed, and where better tow-off and anti-kiting characteristics of the faired cable with respect to previous faired cables are achieved. In particular, the present invention provides an improved fairing assembly, a ring for loading fairings on a towed cable either in compression or tension, and an alternative embodiment of fairing. All fairings according to the present invention may be reeled and unreeled over a sheave or onto a drum or winch, and certain embodiments are provided that have a greater compliance to accommodate relatively small diameters of sheaves, drums and winches, and that have torsional compliance where it may be necessary to turn the fairings on the cable through 180 degrees in a fairly short distance.

BACKGROUND OF THE INVENTION

Faired cables have been well known and used for underwater towing operations of all sorts. In particular, faired cables are used for such underwater towing purposes as submarine detection, and other military uses and purposes such as a deployed radio antenna from a submarine; and for other purposes such as petroleum, trace element or geophysical underwater exploration. In all of these cases, a towed body (or buoy) is towed behind a moving vessel, with the cable between the vessel and the towed body generally assuming or adopting a catenary curve. It is also well known that faired cables generally provide a much better performance by reducing the resistance to motion, or cable drag, of the towed cable as it moves through the water.

However, it has been found in the past that most fairings have certain tow-off or kiting characteristics. These come about when the fairing is not perfectly aligned with the relative flow, so that the fairing tends to act like a wing creating side lift, by which the fairing and the cable with which it is associated moves to the side, thus creating kiting or tow-off.

It has been the general intention that fairings that are assembled onto a cable will be freely mounted so that they may articulate about the cable, with the result that ony a small hydrodynamic restoring force is needed to drive the fairing into alignment with the flow. Unfortunately, however, it has been the general experience with highly streamlined fairings—which are generally light weight plastic, having flexible noses—that there is a frictional resistance or stiction at the interface between the cable and the fairing, as well as interference between adjacent fairing segments. The interference between adjacent fairing segments may particularly be caused by an axial component of the hydrodynamic drag forces, which causes the fairing segments to be stacked in compression, and which cause the frictional resistance to occur and thereby precludes free articulation of the fairing on the cable. In some cases, the fairing may stall or lock onto the cable at some angle to the direction of flow; and the mis-alignment of the fairing may adopt a wedged or a saw tooth configuration which is hydrodynamically disadvantageous.

The prior art comprises several patents of special interest, including the patent which teaches the most generally accepted plastic fairing having a flexible nose, and which is widely used in both military and commercial operations. That patent is HALE et al U.S. Pat. No. 3,611,976, issued Oct. 12, 1971, assigned to the same assignee as the present invention. The previous HALE et al patent teaches a structure by which nose and tail portions of the fairing are assembled in line with one another, and in which there is a flexible link provided between each adjacent pair of fairings. Moreover, the Hale et al patent teaches a successful fairing structure which has a flexible nose capable of being flexed in the forward direction so as to be reeled and unreeled over a sheave and onto a winch or drum. In some respects, fairings according to the present invention have a similar general appearance to the fairings taught by the Hale et. al. U.S. Pat. No. 3,611,976.

ARMSTRONG, in U.S. Pat. No. 3,092,067, issued June 4, 1963, teaches a tandem fairing which, when mounted to a cable, includes what is essentially only a tail portion that is secured around a cable by a plurality of clips along its length. However, of interest in the Armstrong patent is the fact that a number of rings are provided along the length of the cable which are intended to preclude substantial longitudinal motion of the fairing relative to the cable. However, the Armstrong fairing does not sufficiently streamline a cable so as to reduce the cable drag, neither is it practical in the sense of reeling and unreeling.

ANASTASIO et al, in U.S. Pat. No. 3,407,777, issued Oct. 29, 1968, teach a ring which is bonded around the circumference of a cable for the purpose of supporting cable fairings and the like. Anastasio et al have noted the tendency of certain fairings to kite, and provide a complicated fairing structure having stainless steel nose pieces and a polypropylene tail section, with alignment rods between adjacent sections, having a ring mounted at the centre of each fairing section. This not only provides a very heavy and cumbersome structure, it is very costly to assemble and extremely difficult to repair in the field. Moreover, because of the nature of the fairing structure, having bevelled ends on the steel nose sections, there is turbulence and therefore not as efficient reduction in drag as is possible using the Hale et al fairings referred to above.

CALKINS, in U.S. Pat. No. 3,352,274, issued Nov. 14, 1967, provides a theoretical explanation of the effect of hydrodynamic forces in restoring a fairing to be in alignment with respect to the direction of flow. However, Calkins discusses a theoretical hydrodynamic centre, in a substantially solid structure, having only a pair of cavities throughout the length of the fairing to accommodate what is, in essence, a twisted pair of wires that do not contribute to the structural design of the overall towed structure. In other words, the fairing structure is also a tension structure. For most deep towing, and military purposes, Calkins does not provide a practical structure, and fails to appreciate the problems that are presented when towing an underwater body at the end of a cable which may be up to several thousand meters in length.

RATHER et al, in U.S. Pat. No. 3,233,571, issued Feb. 8, 1966, provide a large fairing structure which may be instrumented, and which has a shoulder for each fairing secured to a cable so as to preclude longitudinal displacement of fairing structures along the cable towards the towed body. The structure of the Rather et al, fairing is also provided with a cantilevered weight forward of the leading edge of the fairing, so that it may not be reeled without first removing the fairings from the cable.

SILVEY, in U.S. Pat. No. 4,075,967, issued Feb. 28, 1978, provides a fairing section having a nose portion and a trailing body portion, with a plurality of veins which are upstanding from the trailing body portion. Silvey also provides spacer rings along the cable, one for each fairing section, which act to prevent the fairing sections from sliding down the cable and which thereby act to prevent the fairing sections from crushing one another at the bottom of the cable when they are being towed.

Some of the prior art patents, include the use of shoulders, spacer rings or supporting rings, and in patents the rings are employed so as to preclude relative motion of the fairing segments above them downwards along the cable. Such rings are otherwise known as "stacking rings", and in all of the prior art the rings act in such a manner that the fairing elements above them are compression loaded against them due to the axial component of the hydrodynamic forces acting upon the fairings.

However, as noted, there are primarily two causes of two-off or kiting, and they are the frictional interference between the cable and the fairing (stiction), and the axial intereference between adjacent fairings on the cable. Both of those causes will occur in any of the prior art fairing assemblies, and particularly the second cause will occur in any assembly where stacking rings are used, against which a plurality of fairings are "stacked" or forced against one another in compression. In any prior art assembly using rings which are secured to the cable, except in those instances where one ring is used per fairing element, the plurality of fairing elements above the ring are forced into compression against the ring.

Other difficulties that have arisen with prior art fairing assemblies for underwater towed cables include the fact that it is necessary to provide for reeling and unreeling of the towed cable over sheaves and onto winches or drums. This is provided for in the case of the Hale et al prior art fairing by the flexible nose; and in some of the other prior art fairings by the provision of a shaped steel nose, having a general curved configuration in the leading edge of the nose which approximates the curvature of the sheave or drum.

However, occasionally excessive radial torque will occur, as well as excessive lengthwise torque along the longitudinal axis of the cable and the fairings, such that a tail portion of a fairing may break away from its nose piece because of the shear forces generated. A principal object of this invention is to provide a means in the fairing structure that precludes such failure, and therefore assures the structural integrity of the fairing assembly, without the occasional loss of a tail portion of a fairing.

Moreover, yet another improvement is made by the present invention that causes the natural bend radius for the fairing assembly during reeling and unreeling to be the same as that of the cable. This further change also provides an additional compliance, so that the tail portions of a fairing assembly may spread apart one from another during reeling or unreeling, without undue stress occuring in the nose portion of the fairing assembly.

There may also arise from time to time and particularly depending upon the physical installation and the manner of the run which the faired cable must make from its winch or drum to a sheave and thence underwater, the need for the fairing orientation to be turned over by 180 degrees within a distance of as little as a few meters. When fairing tail portions are related one to another by flexible links passing between them, or by virtue of being assembled or integrally constructed with their nose portions, it is clear that some means must be provided to permit torsional compliance of a group of tail portions so as to permit re-orientation of the tail portions over a short distance. Over a long distance—say 50 meters—a gradual torsional displacement of the tail portions through 180 degrees may occur, but this may not be possible due to the physical constraints of space alloted for the winching and reeling apparatus for the towed cable on board the vessel.

This invention recognizes that there are certain conditions when it may well be desired to place groups of fairings on a cable in a compression loading relationship, and in so doing the present invention provides a structure by which such groups of fairings may be defined and installed on a cable relative to a stacking ring that is assembled to the periphery of the cable. The fairings in such asssembly overcome the difficulties previously spoken of, particularly the tendency to lose tail portions during reeling or unreeling, and as well the present invention provides a means whereby limited relative motion of the fairing segements along the cable between stacking rings is permitted.

In a more general application, however, and contrary to the prior art approaches, the present invention provides a means of suspending groups of fairings along a towed cable by off-setting the tail portions with respect to the nose portions in any group; so that relative motion of the fairing groups downwards along the cable due to the usual stacking forces causes the fairings within each group to be placed in tension and to spread apart one from another. There is therefore no tendency of adjacent fairings, or indeed of adjacent fairing groups, to bind with one another at the interface between them. In each fairing group there is a tensile string of fairings that is thereby created, with the ring which is secured to the cable in each group acting as a suspension ring so as to support the downward load of the fairings below the ring, rather than above the ring as before.

Moreover, the present invention also provides for a unique assembly of a stacking or suspension ring onto the periphery of a cable—particularly an unsheathed cable—whereby motion of the ring per se along the cable is substantially precluded. Moreover, the ring of the present invention, and the tool by which it is applied, are such that application or repair as necessary may be made in the field (such as aboard ship).

The improved fairing of the present invention substantially precludes the tendency to occasionally lose a tail portion during reeling or unreeling, and has a nose portion which is flexible and which has a substantially circular opening throughout its length, where the nose portion is split along its length to the rearward side thereof so as to permit it to be placed over a cable, and where the rear portion has a pair of rearwardly extending legs and a pair of flanges which extend sideways, one from each leg, with one leg and one flange at each side of the split. The tail portion comprises a pair of separable and substantially identical half pieces, each of which has an inner and outer surface, and each of the half pieces has at least one locating pin at the forward edge of its inner surface, which locates in one of a plurality of mating recesses formed in the legs of the nose portion, forward of the flanges. The outer surfaces of the half pieces, when assembled to the nose portion, have a substantially smooth surface in the general shape of an airfoil. Each of the half pieces of the tail portion has at least one supporting pin and a meeting recess formed on its inner surface, so that a pair of identical half pieces will mate with their supporting pins and recesses in co-operating relationship when the pair of half pieces are placed with their inner surfaces facing each other. A channel is formed along the length of each half piece rearward of the at least one locating pin, so as to receive at least a lengthwise portion of one of the flanges of the nose portion, and there is at least one shear block formed in each channel. Each shear block has a shear strength in the lengthwise direction of the fairing, higher than the shear strength of the locating pin; and there is at least one discontinuity in each flange of the nose portion to accommodate the respective shear block of the mating tail portion half piece.

A particular advantage of the above-described fairing configuration, that is has considerably less tendency to lose a tail piece or a half tail piece during reeling or unreeling of a faired cable assembly, comes particularly because of the incorporation into the fairing structure of shear blocks, and is discussed in greater detail hereafter.

Moreover, an assembly of fairings such as those described above can be easily made, whether the fairings are placed either in compression or preferably in tension, and includes a ring which is secured to the periphery of the cable at at least one point along the length of the cable, where the ring has a length less than the length of any tail portion of any fairing. A first tail portion is adjacent the ring, with the forward end of the first tail portion being mated to first and second nose portions, each having a length which is less than the length of any tail portion. The first nose portion has a rearwardly directed edge which is remote from the ring and which is flush with the edge of the first tail portion, and the second nose portion overlies a portion of the length of the first tail portion and a portion of the length of the second tail portion adjacent to the first tail portion. A plurality of nose portions and mated tail portions is then mounted along the length of the cable, with the cable being accommodated in the lengthwise opening of each of the nose pieces. At least periodically along the length of the faired cable assembly, there are adjacent tail portions which are joined one to the other by a flexible link piece which has an opening formed at each end thereof, each of the openings being of sufficient size to accommodate a supporting pin which is in one of the adjacent tail portions; and there is an opening through at least the facing ends of the adjacent tail portions so as to accommodate the flexible link which is passed therethrough.

When the assembly is placed in compression, as discussed above, the tail portions other than at the first and second nose portions and the ring, are assembled directly behind their respective nose portions, and a flexible link is secured over the supporting pins between each adjacent pair of tail portions. In such assembly, the plurality of fairings and the first nose portion are above the ring which is secured to the cable, and the second nose portion is below the ring, when the cable is deployed underwater for towing.

On the other hand, when it is desired that the fairing assembly be placed into tension, as is the usual case in this invention and which is in contradistinction to all prior art assemblies, the fairings are assembled other than at the first and second nose portions and the ring, into groups of fairings where the tail portions within each group are in stepped or staggered fashion with respect to the nose portions within that group, and having a nose portion of one half length of the other nose portions assembled at the top and bottom ends of each group, with a flexible link secured over the supporting pins between the topmost and bottommost tail portions of each adjacent pair of groups of fairings. In the tension assembly, the groups of fairings and the first nose portion are below the ring, and the second nose portion is above the ring, when the cable is deployed underwater for towing.

The present invention provides a novel ring assembly for securement to the periphery of cables, particularly unsheathed cables, which comprises a circular, hollow cylindrical collar of a compressible synthetic rubber-like material, having a slit from one end to the other so that it may be placed over a cable. The inner circumference of the collar is substantially equal to the circumference of the cable, and there is an adhesive layer in the inside surface of the collar. A hard brass outer sleeve which is also of generally circular and hollow cylindrical configuration is provided, and the outer sleeve also has a slit from one end to the other end thereof so that it may be put in place. There is a chamfered inner surface at one side of the slit, and a chamfered outer surface at the other side of the slit, with the chamfers each being substantially identical to each other. The circumferential length of the outer sleeve from one side of the slit to the other side is greater than the other circumference of the collar, so that when the brass sleeve is placed over the collar, the chamfered surfaces face and overlap each other. A solder coating is provided on each of the chamfered surfaces; and when the soldered coating is heated using a tool which is also provided by his invention, a solid sleeve is obtained. The tool comprises a hollow barrel to accommodate hot air blown thereinto, and a heating foot at the end of the barrel which is adapted to be heated by the hot air and has vents formed therein for the hot air to exit away from the heating foot and barrel, and clamp means to clamp the brass sleeve against the heating foot which is curved so as to accommodate the same when the tool is used, hoop stress is created within the brass sleeve and compression forces are created by the brass sleeve against the collar. After the brass sleeve is heated and the chamfered surfaces are soldered to each other, and after the assembly has cooled down and the tool is disassembled, the hoop stress and compression forces remain in the brass sleeve.

There also occurs certain circumstances where it is desirable that the flexible link which joins adjacent groups of fairings in tension, or adjacent fairings when in compression, has an elastic memory. This permits the adjacent tail portions joined by the link to move apart from each other at times, and to be restored to their more general proximal relationships at other times, due to the elasticity of the link. Generally such link is formed in the shape of a U, where each leg of the U is installed in the tail portion of one of the pair of adjacent tail portions that have the flexible link between them.

A further embodiment of fairing is also provided by this invention, and it is intended for use in association with other similar fairings, where the fairings may generally be used in a shorter faired cable assembly or in situations where it is desirable that the fairing may be assembled and disassembled from the cable relatively quickly and without destruction of the fairings. The further embodiment of fairing comprises a nose portion and a plurality of tail portions which are constructed integrally with one another, where a substantially circular opening is formed in the nose portion throughout its length, and is defined in its forward portion by the inner surface of the forward portion of the nose, and at its rearward portion by inwardly directed curved shoulders which are formed inwardly from the sides of the fairing; and where the shoulders are split from each other. The plurality of tail portions are each formed integrally with the nose portion and extend rearwardly therefrom, with the tail portions being separated from each other by slits which extend rearwardly from the region of the shoulders to the end of the fairing. The outer surface of the fairing is substantially smooth and in the general shape of an airfoil, except at the slits. The walls of the fairing are of substantially constant thickness except in the regions of the curved shoulders, and the fairing structure is split at its rearmost end so that the sides may be separated from one another so as to place the fairing over a cable, with the cable being accommodated in the substantially circular opening throughout the length of the nose portion thereof. The material of the fairing has elastic memory, so that when it is placed over a cable and the sides are released, it will restore itself to its configuration where the rearmost ends of both sides of the fairing are in close proximity to each other. Moreover, the nose portion of the fairing may be flexed in a forward direction such as when the faired assembly is reeled or unreeled over a sheave or onto a drum or winch, but it is capable of restoring itself to a substantially straight configuration when deployed underwater.

Normally, at least one slot is formed in the forward portion of the nose portion of the fairing described immediately above, so as to accommodate the ring secured to the periphery of the cable. The alternative fairing embodiment just described is normally formed of rigid, extruded polyurethane or vinyl.

On the other hand, the first embodiment of fairing which is provided by this invention comprises injection moulded components, where the nose portion is normally formed of a polyurethene, and the half pieces of the tail portion are formed of a more rigid material such as acrylonitrile-butadiene-styrene.

One of the practical problems that occurs in preparing faired cable assemblies is the fact that there is a relatively wide range of tolerances with respect to the diameter of the cable to be faired, as well as the likelihood of the existence of a raised or projecting strand of armour, such that the surface of the cable may become a somewhat unreliable bearing surface. Moreover, the fairings themselves are also subject to certain manufacturing tolerances, so that the nominally circular opening through the nose portion of the fairing through which the cable passes may, in fact, be slightly oval in shape from time to time.

The present invention recognizes and overcomes these problems by the provision of a fairing system that can tolerate the existence of a relatively large clearance between the fairing and the cable—in the order of 5 to 10 percent of the cable diameter. Moreover, the present invention provides a faired cable system that, especially when the fairing groups are in tensile strings rather than compression columns, there is a greater tendency of the fairings to align themselves with the direction of flow due to the apparent forward movement of the centre of rotation of the mass of the fairings, especially at small tow-off angles.

By providing a fairing assembly, especially a tensile string which is suspended in discrete lengths from the suspension rings that are secured to the periphery of the cable, a faired cable assembly is provided that allows for unimpeded articulation of the fairings around the cable. Moreover, when the fairing segments are flexibly connected to each other, and the interconnection between the nose portions of the fairing segments is resilient, and also the fairing segments themselves are resilient both in bending and in torsion, the axial hydrodynamic forces that are developed are successfully resisted. This allows the fairing tail portions to remain free from frictional interference with one another, and they may thereby utilize any restoring forces that they may receive as the faired cable assembly moves through the water to maintain them in line with the direction of flow.

There are thus provided by the present invention several embodiments of fairings which can be placed in compression or tension when in assembly with other fairings; and especially an embodiment of a fairing for use in a reasonably permanent installation in a faired cable assembly which can, however, be assembled and/or repaired in the field.

An object of the present invention is, therefore, to provide fairings which may be placed in tension as well as in the usual compression arrangements, which can be easily installed and repaired in the field, and which do not have any tendency to lose tail portions during reeling or unreeling.

Moreover, the present invention provides alternative embodiments of fairings which can be produced using simple plastics injection and extrusion moulding techniques, without the necessity for extensive machining operations, and without the necessity for the use of any metallic nose or tail fairing components.

Yet another object of the present invention is to provide a stacking or suspension ring which may be easily and quickly secured to the periphery of a cable, especially an unsheathed cable, even in the field, and which retains the hoop stress and compression forces that are created or induced in the ring components during its assembly.

A tool for the installation of the stacking or suspension ring is also provided by the present invention.

BRIEF DESCRIPTION OF THE DRAWINGS

These and other features and objects of the invention are specifically described hereafter, in association with the accompanying drawings, in which.

DESCRIPTION OF THE PREFERRED EMBODIMENTS

Figure 1:
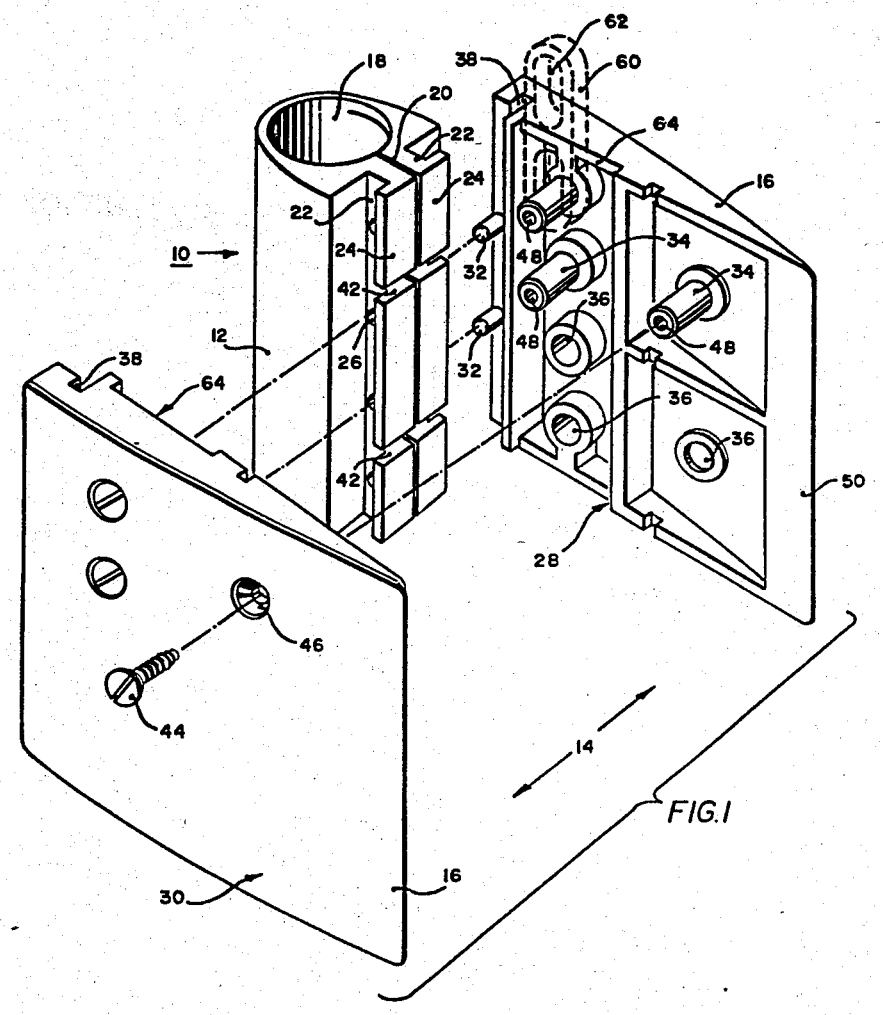
FIG. 1 is an exploded view showing the general assembly of a first embodiment of fairing according to the present invention, especially when it is placed in a compression assembly.

In the following discussion, like reference numerals are used to indicate and define similar fairing components in the various views that are discussed hereafter.

As mentioned above, there are several embodiments of fairing that are provided by the present invention, and several different methods of assembly of the fairing components. Moreover, various further alterations and refinements to one or two general embodiments of fairing are also provided, the reasons and explanations for which follow.

In the first instance, the present invention provides a general fairing assembly, for use with towed underwater cables, such as the fairing assembly 10 shown in FIG. 1. Similar fairings are employed in a faired cable assembly, as described hereafter.

In general, the fairing assembly comprises a nose portion 12 and a tail portion 14 which, in turn, comprises a pair of separable and substantially identical half pieces 16.

The nose portion 12 has flexibility both in torsion and is bendable along its axis, and is generally injection moulded of a material such as polyurethane. It has a substantially circular opening 18 throughout its length, and is split at 20 along its length to the rearward side of the opening 18. At each side of the split 20 there is a rearwardly extending leg 22, and at the rear end of each leg 22 there is an outwardly extending flange 24. There are a plurality of recesses or locating holes 26 formed in each of the legs 22, for purposes discussed hereafter.

Each tail half piece 16 is substantially identical to the other, and each has an inner surface generally designated at 28 and an outer surface 30. At the forward edge of the inner surface 28 of each half piece 16, there is at least one and there are generally two locating pins 32, each of which will mate with one of the locating holes or recesses 26 that are spaced along the legs 22 of the nose portion 12. When assembled, either in the manner indicated in FIG. 1 or in FIG. 2—discussed hereafter—the outer surfaces 30 of each of the half pieces 16, together with the outer surface of the nose portion 12, form a generally smooth and continuous surface, which when viewed in cross-section is generally in the shape of an airfoil. That matter is discussed also in greater detail hereafter, particularly with reference to FIG. 8.

Each of the half pieces 16 has at least one supporting pin 34, and generally three supporting pins as shown; and there are also a similar number of mating recesses 36. It is obvious that when two identical half pieces 16 are placed in a co-operating relation with their inner surfaces 28 facing each other, the supporting pins 34 of each half piece 16 will mate into the respective recesses 36 on the other half piece 16.

Figure 3:
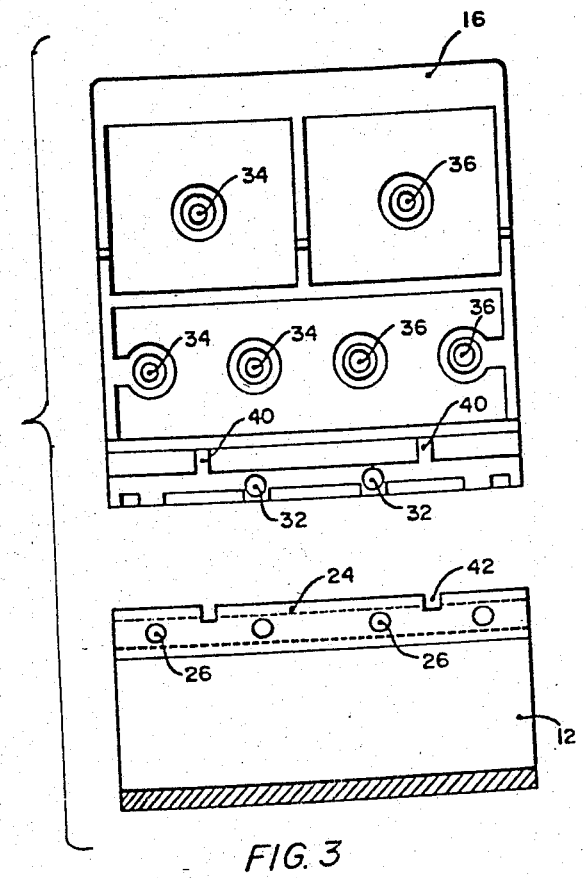
FIG. 3 is a plan view of the nose and tail portions of a fairing of either FIG. 1 or 2.

In each of the half pieces 16 there is a channel 38 which is formed along the length of the half piece rearward of the locating pins 32, in a manner so as to receive one of the flanges 24 or a portion of a flange 24 of a nose piece 12. Moreover, in each of the channels 38 there is formed at least one shear block 40 (see FIG. 3). Discontinuities 42 in the flanges 24 accommodate the shear blocks 40. As will be explained in greater detail hereafter, the shear strength in a lengthwise direction —i.e., from top to bottom as viewed in FIG. 1—of the shear block 40 is higher than the shear strength of the locating pins 32.

Figure 2:
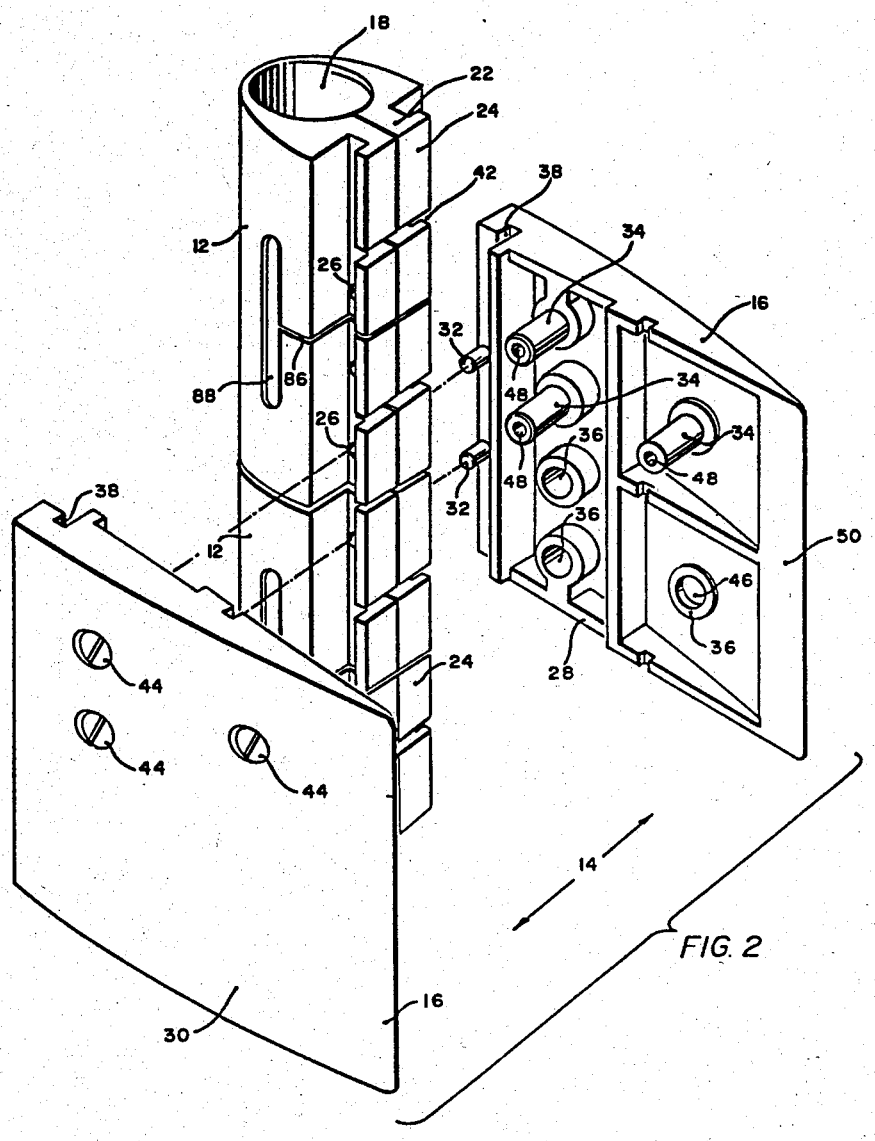
FIG. 2 is a view similar to FIG. 1 but showing the fairing components when placed in a tension assembly.

FIG. 2 is substantially identical in most respects to FIG. 1, except that it is clear that the locating pins 32 of each of the half pieces 16 of the assembly of FIG. 2 located in recesses 26 of two different nose pieces 12. By that assembly, the tail pieces 16 are in a stepped or staggered relationship to the nose pieces 12, as discussed hereafter with reference to FIG. 5. For ease of the geometry of the assembly, the shear blocks 40 and the mating recesses 42 in the flanges 24 of the nose pieces 12, are located in positions that are 0.25 times the length of the respective tail pieces 16 or nose pieces 12 from each end thereof.

It should also be noted that, in the assembly of any of the fairing pieces as shown in FIGS. 1 and 2, in particular, threaded fastening means such as screws 44 may be passed through openings 46 formed at the outer ends of the recesses 36 and into mating threaded recesses 48 that are formed in the supporting pins 34. The assembly of the mating half pieces 16 may also be by way of the provision of an adhesive interface at contacting portions of the surfaces such as the rear portion 50, or by way of ultrasonic welding of the surfaces 50. Other suitable fastening means and techniques may also be used.

Figure 4:
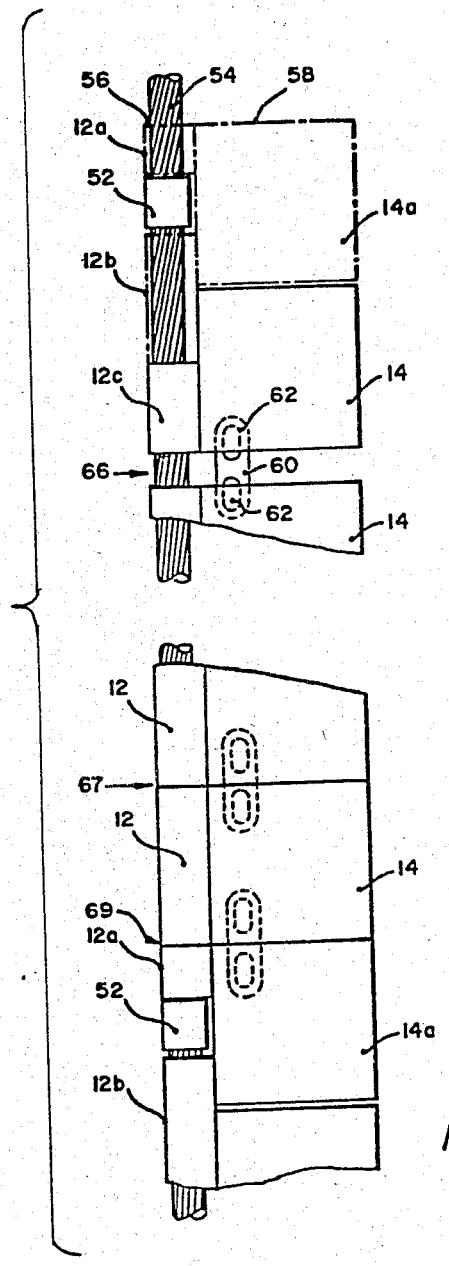
FIG. 4 is a side view, partially broken, of a typical assembly of fairing components in a compression assembly.
Figure 5:
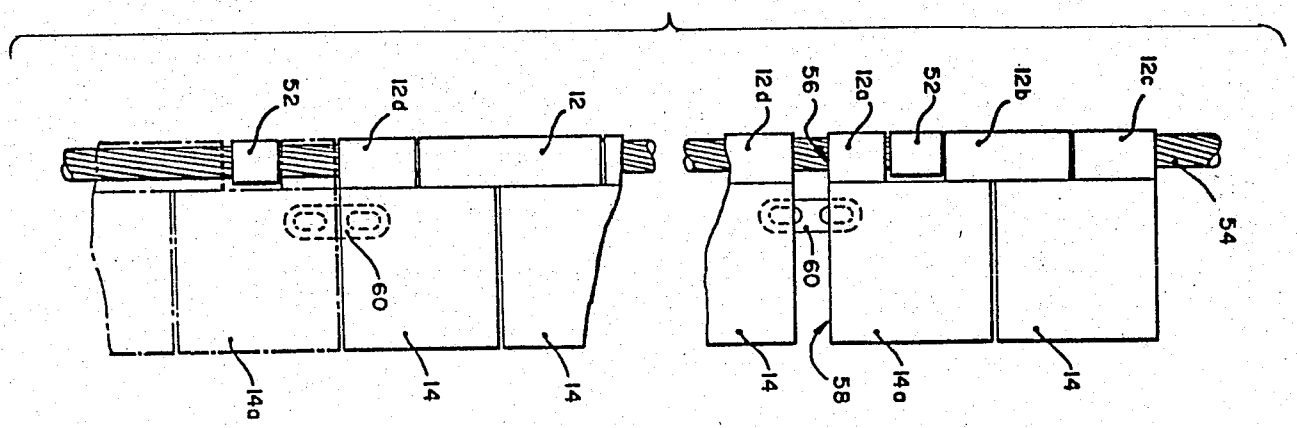
FIG. 5 is a view similar to FIG. 4 but showing the assembly of fairing components in tension.

Referring to FIGS. 4 and 5, assemblies of fairing components as referred to in FIGS. 1 and 2 are shown, where the assembly of FIG. 4 is generally a compression assembly and the assembly of FIG. 5 is generally a tension assembly, as described in detail hereafter.

In any event, in each of the two assemblies, there is at least one ring 52 secured to the periphery of a cable 54. Generally, the rings 52 are secured to the cable 54 at intervals of about 3 to 10 meters. The length of the ring along the cable 54 is less than the length of any tail portion 14. There is a first tail portion (designated **14*a*) adjacent the ring 52, and the forward end of the tail portion 14*a* is mated to first and second nose portions (designated 12*a* and 12*b*, respectively), the length of each of which is less than the length of any tail portion 14. The first nose portion 12*a* has an edge surface 56 which is remote from the ring 52, and the edge surface 56 is flush with the edge surface 58 of the first tail portion 14*a*. The second nose portion 12*b* overlies a portion of the length of the first tail portion 14*a*, and also a portion of the length of a second tail portion 14 which is adjacent to the first tail portion 14***a*. Of course, in the configurations of both FIG. 4 and FIG. 5, the cable 54 is accommodated in the lengthwise opening 18 of the various nose pieces.

At various places along the assemblies of either FIG. 4 or FIG. 5, there are pairs of adjacent tail portions 14 that are joined one to the other by an elongated flexible link piece 60 (which is also shown in ghost lines in FIG. 1). Each flexible link piece 60 has an opening 62 formed at each end thereof, where the opening is of a sufficient size to accommodate one of the supporting pins 34 in each of the adjacent tail portions 14. Generally, so as to accommodate movement of adjacent tail pieces 14 away from one another either due to hydrodynamic forces or during reeling and unreeling, as discussed hereafter, the shape of each of the openings 62 is elongated rather than circular. The tail portions 14 of the fairings have openings defined by slots 64 at each end of each of the half pieces 16, to accommodate the link piece 60 when it is passed through the defined opening. The link pieces 60 are, of course, required only when the tail portions 14 are in line with the nose portions 12 and are not offset or staggered with respect to them.

Referring specifically to FIG. 4, at this time, it will be noted that other than at the mounting of the first and second nose portions 12*a* and 12*b*, with an accommodation for a half nose portion 12*c*, the tail portions 14 are directly behind the nose portions 12, and there is a flexible link 60 between each adjacent pair of tail portions in each grouping of fairings between successive rings 52. In each grouping, the first nose portion 12*a* is above the ring 52, and the second nose portion 12*b* is below the ring 52, and all of the assembled fairings beginning from the first fairing below the nose piece 12*c* down to the next ring 52 are free to move downwards along the cable 54, so that they are placed into a compression relationship one to another and with respect to the lower ring 52 shown in FIG. 4. During towing, there is always an axial component of the hydrodynamic forces that act against the fairings, and that axial force is always directed downwardly. Thus, the fairings tend to move downwards along the cable 14 to the extent that is possible, so that the gap between an upper pair as at 66 is greater in length than, say, the gap 67 or 69 between adjacent fairings in the region immediately above the lower ring 52. Obviously, in this case, the lower ring 52 functions as a stacking ring. Notwithstanding the improvements that are otherwise provided by this invention, there may still be some possibility of fairings to have frictional interference one with another at their adjacent end surfaces, as discussed hereafter with reference to FIG. 6.

Turning, for the moment, to FIG. 5, a fairing assembly is shown which is a tension assembly, and in this instance it is noted that the relationship of the fairing nose pieces 12*a*, 12*b* and 12*c* is reversed to that of FIG. 4; that is, nose piece 12*a* is below its respective ring 52, and nose pieces 12*b* and 12*c* are above it. Moreover, it will be noted in this assembly that there are groups of fairings, and within each group the tail portions are in stepped or staggered fashion with respect to the nose portions, with the assembly being as shown in FIG. 2. Within each group, there is a nose portion 12*d* at the top and bottom of the group, each of which is otherwise identical to nose piece 12*c* and is of one-half length of the other nose portions 12 within the group. There is also a flexible link 60 between the topmost and bottom-most tail portions of each adjacent pair of groups of fairings; with the fairing assembly including the tail portion 14*a* being referred to in this embodiment as the "hanger" fairing. Clearly, in this embodiment, the downwardly directed hydrodynamic forces cause a tension assembly between the groups of fairings, suspended from the upper most ring 52, so that there is no lengthwise interference of any fairings with any other fairings during towing.

Moreover, it is possible that there may be fewer nose portions than tail portions in each group of fairings between link pieces 60, where each of the nose portions in each group overlies more than two adjacent tail portions. In other words, the nose portions may be twice as long or longer than the tail portions 14.

Figure 6:
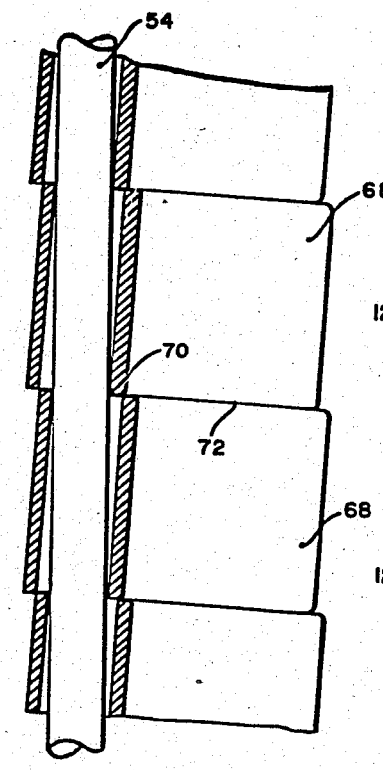
FIG. 6 PRIOR ART
FIG. 6 is a side view showing of a problem that could occur in prior art faired cable assemblies where the fairing components are in compression, and is marked "prior art"

Referring to FIG. 6, an assembly of prior art fairings 68 is shown, where each fairing 68 may be such as those referred to above in respect of Hale et al U.S. Pat. No. 3,611,976. Here, it is shown that the fairings may be "saw-toothed" one with respect to another when in compression, with interference occuring at points 70 with the cable and in the region 72 at the end surfaces of adjacent fairings. Moreover, the regions 70 may occur at the side of the cable 54, in which case the fairings 68 are "buckled" against each other.

Figure 7:
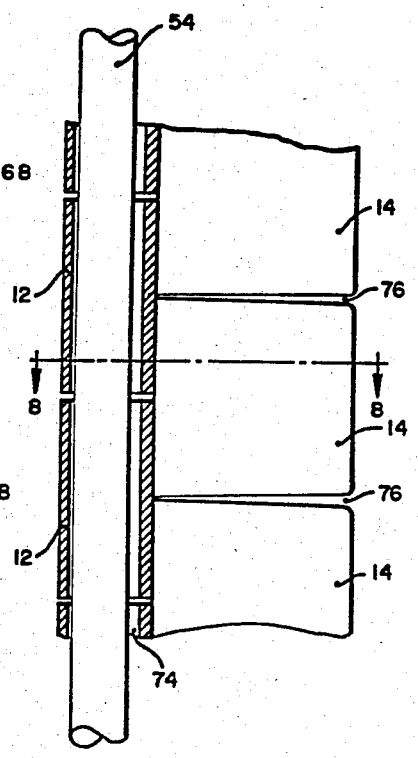
FIG. 7 is a view similar to FIG. 6 but showing a tension assembly according to the present invention.

On the other hand, when the fairings are in tension, as shown in FIG. 7, there is a clearance 74 within the lengthwise opening 18 at the rear of the cable 54, and a clearance 76 between adjacent tail pieces 14. There is therefore no frictional interference of fairing components one with another, nor is there a frictional interference of the inner surface of the openings 18 in the nose pieces 12 with the outer surface of cable 54.

Figure 8:
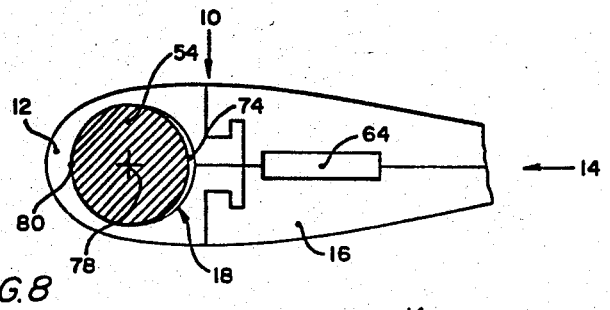
FIG. 8 is a plan view looking in the direction of arrows 8—8 of FIG. 7.

Referring to FIG. 8, a point 78 is shown which lies at the axis of the cable 54. During large angles of attack of the fairing 10 with respect to the direction of flow, (say above 5 degrees) the axis 78 of the cable 54 acts as the centre of pivoting of the fairing 10 about the cable. However, at low angles of attack of the fairing 10 with respect to the angle of flow, (say below 2 degrees, as may occur during kiting or tow-off) the centre of pivoting moves forward to 80, which is essentially a line of contact between the inner surface of the opening 18 in the nose piece 12 and the outer surface of the cable 54. This can occur, however, only when there is a tension assembly such as those illustrated in FIGS. 5 and 7, whereby the clearance 74 at the rearward side of the cable 54 is provided. Obviously, any force F acting against the side of the fairing 10 has a higher moment when it is taken about the pivot centre 80 rather than about the axis 78, and therefore there is less likelihood of kiting or tow-off, even at low speeds. It has been noted that when there is a low angle of kiting or tow-off, in the prior art fairings, there is very little correction of the tow-off, and this is believed to be as a consequence both of the stiction or frictional interference between the surface of the cable and the inner surface of the opening, as well as the interference between adjacent fairing segments. However, especially when there is a tension assembly, both of those frictional or interference impediments to correctional or recovery action due to a sideways acting force of the hydrodynamic flow, are substantially eliminated.

Figure 9:
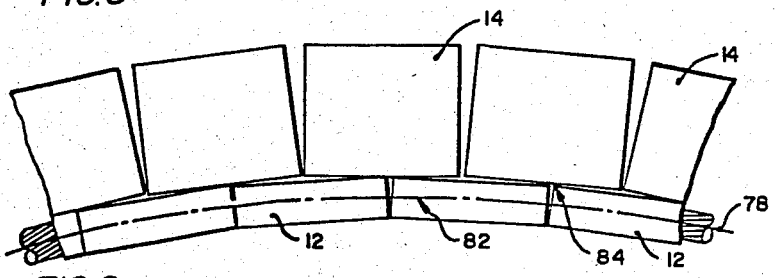
FIG. 9 is a view showing the effect of reeling and unreeling a faired cable assembly similar to that of FIG. 7.
Figure 10:
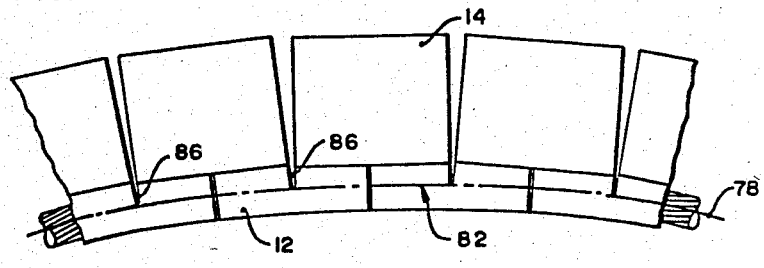
FIG. 10 is a view similar to FIG. 9 showing a further improvement to the fairings.

Referring now to FIGS. 9 and 10, the actions of fairings such as in the tension assembly of FIGS. 5 and 7, when reeling or unreeling, are shown with and without a further improvement to the fairing assembly as contemplated by the present invention. In FIG. 9 a small segment of arc is shown where a faired cable assembly passes over a sheave or onto a winch or drum. The axis 78 of the cable marks the cable radius 82, that is to say the radius of wrap of the cable, and it is different than the fairing radius 84 due to the configuration of the fairings. This points out, among other things, the purpose of the shear blocks 40, because it will be recognized that there is a tendency of the tail pieces 14 to try to shift with respect to the nose portions 12 during reeling or unreeling, with the result that occasionally a sufficient shear force develops between the mating nose and tail portions that damage may occur. The provision of the shear blocks 40, however, is such that if damage is to occur, it will be by breakage of the locating pins 32 in shear, but the occasional broken locating pin 32 does not result in the loss of a tail piece 14 if the shear blocks 40 are in place to preclude further movement of the tail piece with respect to the nose piece.

Moreover, in the embodiment of FIG. 9, the natural bend radius of the fairing string occurs at the 84 interface between the nose and tail portions, whereas the cable bend radius 82 is on the cable axis and through the circular nose aperture of the fairings. Consequently, when a faired cable traverses a sheave, the cable responds to a shorter path than that of the fairing. Relative movement thereby occurs where the fairings move faster and are thus forced to creep along the cable during sheave traverse. This is particularly undesirable, since the fairings apply high shear loads to the cable rings as their relative movement along the cable is impeded by the cable rings.

A further embodiment of the fairings as described so far is contemplated, however, in FIG. 10 and with respect to FIG. 2. In that embodiment, a slit 86 is formed in each side of the nose portion at its rear, through the flanges 24 and the legs 22 and forwardly along the side of the opening 18 to about the centre thereof. That slit provides a means whereby, as shown in FIG. 10, both the radius of wrap for the cable and the fairing are at 82, along the axis 78 of the cable. Thus, no excessive shear load develops on the rings.

A further embodiment is also contemplated in FIG. 2, whereby greater torsional compliance of the nose porions 12 of fairings may be achieved. In that instance, a slot 88 is formed along each side of the nose portion 12, and extends lengthwise along each side of the nose portion 12. Clearly, the length of the slot is less than the length of the nose portion, and is conveniently from 0.1 to 0.7 times the length of each nose portion in which the slot 88 is formed.

The purpose for the slot 88 is to provide much greater torsional compliance of the fairing assembly; and in practice, a fairing nose piece 12 having a slot 88 formed therein is provided only once every one to three meters along the length of a faired cable assembly. By the provision of the slot 88 at intervals along the faired cable assembly, it is evident that an assembly of fairings as shown in FIG. 5 may be handled—such as during reeling or unreeling—in such a manner that the fairing tail pieces 14 may be reoriented by being turned through 180 degrees over a short run. Rather than creating undue torsional forces in the fairings, the slot 88 provides the necessary compliance whereby such overturning of the fairing tails may be easily accomplished.

Figure 11:
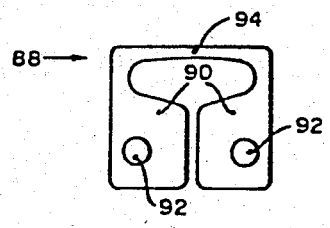
FIG. 11 is a plan view of an alternative embodiment of flexible link which may be used between adjacent fairings.

As suggested above, there may arise certain occasions when it is convenient that the flexible links between adjacent tail portions 14 have a particular elastic and restorative memory. Such a flexible link is shown in FIG. 11 at 88, and has the general shape of a U with legs 90 and openings 92 in each leg to accommodate one of the supporting pins 34. When assembled, each of the legs 90 of the link 88 extends rearwardly within its respective tail portion 14, and the base 94 of the U extends between the adjacent tail portions. The link 88 has an elastic memory which permits the legs 90 to flex away from each other under exertion of a force between those legs which is greater than a predetermined force, such as when the faired cable assembly is being reeled or unreeled over a sheave or onto a winch or drum. The elastic memory is such as to restore the original configuration of the legs 90 when the force between them is less than the predetermined force, that force being a longitudinal force along the faired cable assembly between the supporting pins that are accommodated in the openings 92 of the flexible link 88.

Generally, the material of the modified flexible link 88 is a metal having a relatively high modulus of elasticity, and may be stainless steel, spring steel, a composite of a metal such as steel incapsulated in an elastomer, or other suitable material.

Figure 12:
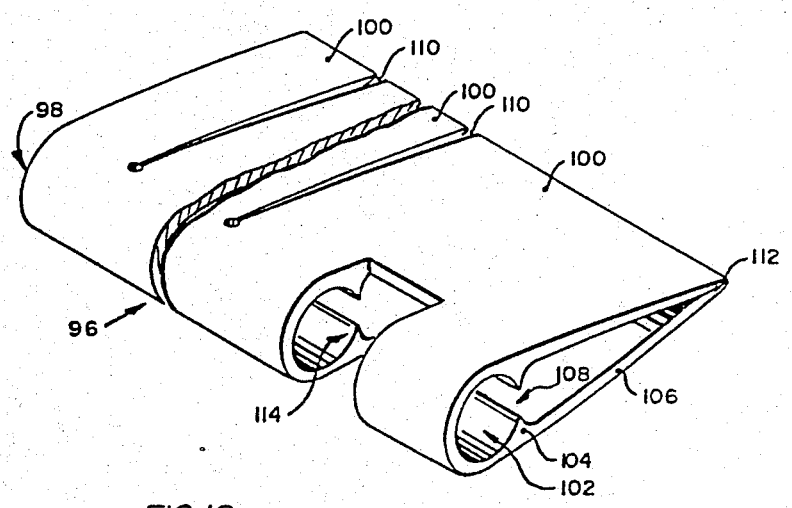
FIG. 12 is a general perspective view of a further embodiment of fairing according to the present invention.

Referring now to FIG. 12, a further embodiment of fairing is shown, being to some extent an adaptation of a clip-on fairing sold by the assignee of the present invention in association with its trade mark "RIG-STREAM". However, the fairing embodiment of FIG. 12 is one which incorporates a number of the features of a tensile string of fairings such as shown in FIG. 5 herein, including the adaptability of the nose portion of the fairing to a suspension or stacking ring, as discussed hereafter.

The fairing 96 of FIG. 12 has a nose portion 98 and a plurality of tail portions 100 which are constructed integrally with one another. Within the nose portion 98 there is a substantially circular opening 102 throughout the length of the fairing, which is defined in its forward portion by the inner surface of the forward portion of the nose portion 98, and in its rearward portion by a pair of inwardly directed curved shoulders 104, each of which is formed inwardly from the sides 106 of the tail portions 100. There is a split 108 between the shoulders 104.

All of the tail portions 100 of a single fairing 96 are formed integrally with the nose portion 98, and extend rearwardly therefrom. The tail portions 100 are separated from one another by slits 110 which extend rearwardly from a forward extremity which is approximately that of the axis of the circular opening 102, to the rear end of the fairing assembly. Clearly, the outer surface of the fairing is substantially smooth except at the slits 110, and in common with the other fairings of the present invention it has the general shape of an airfoil.

The walls 106 have a substantially constant thickness except in the regions of the curved shoulders 104. The fairing is split at its rearmost end, at 112, so that the sides 106 may be separated from each other. The split 112 therefore permits the fairing 96 to be placed over a cable, with the cable being accommodated in the substantially circular opening 102. In order for the fairing 96 to close over a cable, the material from which it is made has an elastic memory so that when the sides 106 are released, they will restore themselves to the original configuration where the rearmost ends of both sides are in close proximity to each other at the split 112. Morever, the material of the fairing 96 is also sufficiently flexible that the nose portion 98 may be flexed in the forward direction such as when the faired cable assembly is reeled or unreeled over a sheave or onto a drum or winch, but has sufficient elastic memory that the nose portion will restore itself to a substantially straight configuration when deployed underwater.

So as to accommodate a suspension ring or stacking ring, as discussed above and described hereafter, there is at least one slot 114 formed in the forward portion of the nose portion 98. In general, the slot 114 is formed near one end of the fairing 96, and the fairing is mounted to a cable with the slot 114 near its upper end so that it is substantially a tensile assembly.

The material from which the fairing 96 may conveniently be made may be a substantially rigid, extruded polyurethene or vinyl.

Figure 13:
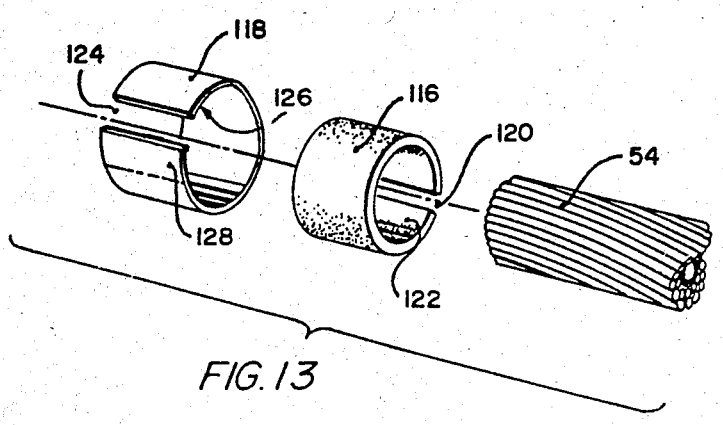
FIG. 13 is an exploded view showing the general assembly components of a stacking or suspension ring according to the present invention.

Turning now to FIG. 13, a ring assembly for securement to the periphery of a towed underwater cable 54, is shown. That assembly comprises a collar member 116 and a sleeve member 118, each of which has a generally circular and hollow cylindrical configuration. The collar 116 is made of a compressible synthetic rubber-like material such as NEOPRENE (trade mark), and has a slit 120 from one end to the other so that it may be placed over the cable 54 at any location along its length. The inner circumference of the collar 116 is substantially equal to the circumference of the cable 54, and an adhesive layer 122 is placed on the inside surface of the collar 116. The adhesive may conveniently be SCOTCHWELD (trade mark) 2216B/A, but other adhesives may be used. The adhesive provides an interface between the collar 116 and the outer surface of the cable 54, so as to preclude movement of the collar with respect to the cable surface, and fills the interstices between the strands of the cable. (The ring assembly of FIG. 13 may also be installed on an armoured or sheathed cable, but generally it is not because there is a tendency of the armour or sheathe to move with respect to the cable core.)

The sleeve 118 is generally formed of hard brass, such as standard shim stock, for example A.S.T.M. Alloy 260 (being a 70/30 copper/zinc alloy), with half-hard temper. The sleeve 118 is also formed with a slit 124 from one end to the other, and has a chamfered inner surface 126 at one side of the slit 124, and a chamfered outer surface 128 at the other side of the slit, where the chamfers of the surfaces 126 and 128 are substantially identical to each other. The circumferential length of the sleeve 118, measured from one side of the slit 124 to the other side thereof, is greater than the outer circumference of the collar 116, so that when the sleeve 118 is placed over the collar 116, the chamfered surfaces 126 and 128 will face and overlap each other. The chamfered surfaces 126 and 128 are generally pre-tinned with a solder coating, usually 50/50 solid solder, so that when they are heated for an appropriate length of time and at a high even temperature, the chamfered surfaces 126 and 128 will respond to each other.

When the ring assembly is placed on the cable, the collar having the adhesive surface is first placed over the cable at the intended position, and the sleeve is then placed over the collar and tightened so that the chamfered surfaces and overlap face each other. By so doing, a hoop stress is created in the sleeve, and a compression force against the collar is also created. When the chamfered surfaces 126 and 128 have been bonded to each other, the hoop stress within the sleeve 118 and the compression force of the sleeve against the collar 116 are captured and retained.

Figure 14:
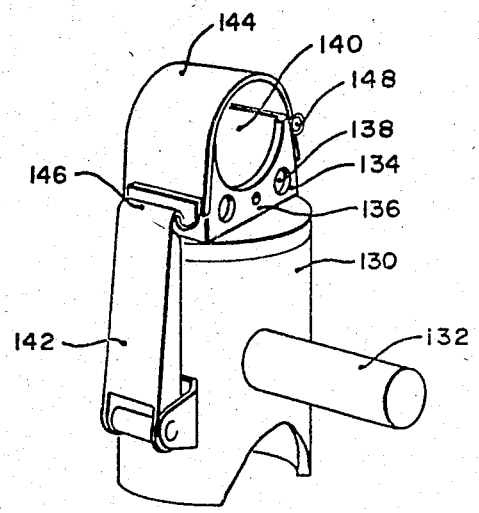
FIG. 14 is a general view of a tool used for assembly of the ring components of FIG. 13.

FIG. 14 is a general view of a tool which is provided specifically for purposes of placing the ring assembly on a cable, even in the field. The tool generally comprises a hollow barrel 130 to which a handle 132 is secured, and the barrel 130 is designed and dimensioned so as to accommodate the end of a heat gun which blows hot air into the barrel. A heating foot 134 is mounted at the end of the barrel 130, and is adapted to be heated by hot air blowing from the barrel against its underside, and through channels 136 that are formed within the heating foot 134. Vents 138 are also provided within the heating foot 134, so that hot air blowing from the barrel 130 into the heating foot may exit away from it.

The upper surface 140 of the heating foot is substantially curved so as to accommodate about half the periphery of the brass sleeve 118 when it is placed into the tool. An overcentre clamp arrangement 142 is provided, having a hook arrangement formed in the end of a strap 144 at 146, and the strap 144 is hingedly mounted to the heating foot 134 at hinge 148. The clamping effect is like a progressive belt tightening, rather than a crimping action, thus creating the desired hoop stress in the brass sleeve 118.

The tool is opened by releasing the clamp and swinging the strap 144 away from its position over the heating foot 134, and the assembled cable, collar and ring are placed into the tool. The clamp 142 is then engaged with the strap 144, and closed so that hoop stress is formed within the sleeve 118. (In general, the facing chamfered surfaces 126 and 128 are placed into the tool so as to face the heating foot 134.) The heat gun (not shown) is then turned on, so that hot air is blown from it into the barrel 130 and against the heating foot 134 so that heat is transferred to the sleeve 118 and the chamfered surfaces 126 and 128 are soldered to each other. If the temperature of hot air coming from the heat gun is in the order 425 degrees C. (about 800 degrees F.), the tool is operated for about 2 minutes before the blowing hot air is discontinued. Thereafter, the assembly is permitted to cool down, and the clamp 142 is undone so as to release the strap 144. However, the hoop stress and compression forces within the sleeve 118 and against the collar 116 remain, so that the ring assembly is securely mounted on the cable 54.

There have been described several embodiments of improved fairings for underwater towed cables, that may be installed on a cable either in a compression assembly or more preferrably in a tension assembly by which more efficient towing without kiting or tow-off is assured.

Several alternative embodiments have been shown, particularly so as to improve the torsional compliance of the nose portions of fairings, as well as to provide for a force circumference—or radius of wrap—of the cable and the fairing assembly to be on the same axis, substantially at the axis of the cable. Examples of various faired cable assemblies have been shown, using several alternative embodiments of fairings. An improved ring assembly, and a tool for installing the same, have been discussed. In keeping with the present invention, the improved ring functions particularly as a suspension ring, rather than as a stacking or stop ring as has been known in the prior art.

Other embodiments and alternatives may be made without departing from the spirit and scope of the appended claims.

What is claimed is:

1. A tool for securing a ring assembly to the outer periphery of a cable comprising:

a hollow barrel to accommodate hot air blown into said barrel;

a heating foot at the end of said barrel, and adapted to be heated by hot air blowing against its underside from said barrel, and having vents formed therein for said blown air to exit away from said heating foot and barrel;

the upper surface of said heating foot, away from said barrel, being substantially curved;

clamp means;

where the ring assembly that the tool is adapted to secure comprises a collar of rubber or rubber-like material surrounded by an outer sleeve of metal;

where the outer sleeve is formed with a longitudinal slit, and where the circumferential length of the sleeve, measured from one edge of the slit to the other edge, is substantially longer than the circumference of the collar;

where the clamp means is so arranged that when the ring assembly is placed against the heating foot, the clamp means is effective, in co-operation with the foot, to reduce the circumference of the sleeve to such an extent that the margins of the material of the sleeve that border the edges of the slit become overlapped over a substantial circumferential distance, and to such an extent also that the collar is compressed to a substantial degree;

and where the heating foot is so arranged that heat transmitted therefrom to the sleeve is effective to solder the said overlapping margins together.

2. The tool of claim 1, where the source of hot air is a heat gun; and where said clamp means is hingedly mounted to said heating foot.

* * * * *